US007607185B1

(12) United States Patent
Minson

(10) Patent No.: US 7,607,185 B1
(45) Date of Patent: Oct. 27, 2009

(54) INFLATABLE INCLINE MATTRESS

(75) Inventor: Kelli Lynn Minson, Arlington, VA (US)

(73) Assignee: Kelli L. Minson, Arlington, VA (US)

( * ) Notice: Subject to any disclaimer, the term of this patent is extended or adjusted under 35 U.S.C. 154(b) by 0 days.

(21) Appl. No.: 12/292,542

(22) Filed: Nov. 20, 2008

Related U.S. Application Data

(60) Provisional application No. 61/129,713, filed on Jul. 14, 2008.

(51) Int. Cl.
*A47C 20/00* (2006.01)
*A47C 27/08* (2006.01)

(52) U.S. Cl. ..... 5/691; 5/731; 5/655; 5/655.3

(58) Field of Classification Search ..... 5/731, 5/733, 700, 632, 633, 644, 655, 655.3, 709
See application file for complete search history.

(56) References Cited

U.S. PATENT DOCUMENTS

| | | | | | |
|---|---|---|---|---|---|
| 1,382,531 | A * | 6/1921 | Newborn | ..... | 5/706 |
| 2,612,645 | A * | 10/1952 | Boland | ..... | 5/644 |
| 4,193,150 | A * | 3/1980 | Vineberg | ..... | 5/632 |
| 4,665,573 | A | 5/1987 | Fiore | | |
| 4,803,744 | A * | 2/1989 | Peck et al. | ..... | 5/713 |
| 4,807,313 | A | 2/1989 | Ryder et al. | | |
| 5,970,549 | A | 10/1999 | Rudden | | |
| 6,112,350 | A * | 9/2000 | Larson | ..... | 5/710 |
| 6,651,283 | B1 | 11/2003 | Cook et al. | | |
| 6,925,670 | B2 * | 8/2005 | Torrez | ..... | 5/731 |
| 7,134,158 | B2 * | 11/2006 | Tokarz | ..... | 5/632 |
| 7,152,264 | B2 * | 12/2006 | Boyd | ..... | 5/706 |
| 7,328,471 | B1 * | 2/2008 | Stohr | ..... | 5/660 |
| 2006/0031996 | A1 | 2/2006 | Rawls-Meehan | | |
| 2007/0169274 | A1 | 7/2007 | Boso et al. | | |

OTHER PUBLICATIONS

AeroBed Full Size Inflatable Air Mattress Aero Bed w/ Carry Case and Fleece Mattress Cover, http://www.amazon.com/gp/product/images/B0007X0HFO/sr=8-3/qid=1235488129/ref=dp_image_0?ie=UTF8&n=1055398&s=home-garden&qid=1235488129&sr=8-3.

Hammacher Schlemmer—The Sleep Improving Pillow Wedge, http://www.hammacher.com/publish/z73049.asp.

Inflatable Bed Wedge—Jobri NoFlux Inflatable Wedge Support Pad, http://sitincomfort.com/inbedwejonoi.html.

Notification of Transmittal and International Search Report dated Aug 24, 2009 issued in PCT/US 09/04034.

* cited by examiner

*Primary Examiner*—Michael Trettel
(74) *Attorney, Agent, or Firm*—Davidson Berquist Jackson & Gowdey LLP

(57) ABSTRACT

The invention is an inflatable, wedge-shaped incline mattress that is inexpensive, portable, easily inflated or deflated, and effectively relieves Gastric Esophageal Reflux Disease (GERD) in adults and infants by elevating the head while lowering the feet relative to the stomach. It also allows for side sleeping, stomach sleeping and rolling over to change sleep positions while still in the head-elevated position.

10 Claims, 2 Drawing Sheets

INFLATABLE INCLINE MATTRESS

CROSS-REFERENCE TO RELATED APPLICATIONS

I hereby claim the benefit under 35 U.S.C. § 119(e) of United States provisional application number 61/129,713 filed Jul. 14, 2008.

BACKGROUND OF THE INVENTION

1. Field of the Invention

The present invention generally relates to beds, and more specifically to inclining mattresses.

2. Background Information

GERD, or Gastric Esophageal Reflux Disease, is a backflow of acid and undigested material from the stomach into the swallowing tube or esophagus. In most patients this is due to a transient relaxation of the "gate" or lower esophageal sphincter (LES) that keeps the lower end of the esophagus closed when a person is not swallowing food or liquids.

The esophagus is not able to cope with acid as well as the stomach and is easily injured. This acid can irritate and sometimes damage the lining on the inside of the esophagus. In some cases, untreated GERD can facilitate the occurrence of Esophageal Cancer.

GERD has a pronounced recurrent character and it generates symptoms such as heartburn, throat inflammation and soreness, difficulty swallowing and difficulty breathing. Obviously, anything that puts pressure on the abdomen, such as tight belts or girdles, can worsen the problem and GERD can be aggravated by a number of factors, including alcohol, tobacco, medications containing aspirin, obesity and stress. When a person lies down to sleep or in particular lies down right after eating, it is easier for food and acid to come back into the esophagus and throat.

Chronic laryngitis, hoarseness, sleep apnea, laryngospasm, wheezing, chronic cough, frequent throat clearing, and snoring are all likely to occur if a person suffers from night-time reflux (GERD), labeled more accurately as Sleep-time Reflux. When lying flat on the back, the stomach is above the esophagus, which, as a result, allows acidic stomach contents to flow more easily through a weakened LES into the esophagus and on to the pharynx where it may also follow a path of least resistance to the trachea and sinus cavities. The end result is some or all of the above mentioned symptoms of GERD.

According to the U.S. Dept of Health and Human Services (National Institutes of Health, NIH Publication #94-1447), 1 in 33 or 3.00% or 8.2 million people in the United States alone suffer from Gastric Esophageal Reflux Disease (GERD) and 60% of babies born every year in the United States are born with GERD.

The most common immediate recommendation by doctors in the U.S. for adults with GERD is to elevate the head of the bed 6 to 8 inches. However, The most common recommendation by pediatricians to parents with newborns suffering from GERD is to keep the infant in an upright sitting position at all times—including sleep time. This often means that these newborns spend almost all of their time being held by an adult or in a car seat or carrier because of the incline position of these devices. Adults also attempt to combat GERD by stacking pillows under their heads and upper bodies or by using a short, shoulder supporting foam wedge under these same areas. But this propping does not work because the feet are still not lower than the stomach and GERD symptoms can be worse when the body bends at the waist. With these approaches, the stomach contents can be trapped above the LES and the symptoms continue or worsen. Also, in the propped up from the waist position, the person may only sleep in one position—on the back—and the short wedge or the mountain of pillows must be stored during the day as the bed cannot be made with them in place.

Accordingly, most or all relevant devices are ineffective primarily because they only serve to elevate the head while not lowering the feet relative to the stomach, and/or limit sleeping to only the back position throughout the sleeping period.

Despite all of the benefits from the current and various mattresses addressing GERD, it would be desirable to have an inflatable incline mattress that is inexpensive, portable, allows the bed to be made as it remains in place, or, alternatively, easily stored and even transported for use elsewhere. Further it is beneficial for individuals to sleep in many positions, and effectively relive GERD by elevating the head without causing the user's body to bend at the waist.

SUMMARY OF THE INVENTION

In view of the foregoing, it is an object of the present invention to provide an inflatable incline mattress.

It is another object of the present invention to provide an inflatable incline mattress that is inexpensive to purchase.

It is another object of the present invention to provide an inflatable incline mattress that is easily placed on top of the user's current mattress.

It is another object of the present invention to provide an inflatable incline mattress that can be rapidly inflated via AC/DC current, or rapidly deflated.

It is another object of the present invention to provide an inflatable incline mattress that is a non-prescription relief for gastroesophageal reflux disease (GERD), or reflux.

It is another object of the present invention to provide an inflatable incline mattress that helps to reduce and avoid possible damage to the esophagus from GERD.

It is another object of the present invention to provide an inflatable incline mattress in which the design allows the user to have side sleeping, stomach sleeping and rolling over, just like in a normal bed.

It is another object of the present invention to provide an inflatable incline mattress in which the design allows for sleep in most any normal position.

It is another object of the present invention to provide an inflatable incline mattress in which the design prevents slipping downward toward the foot of the bed and prevents neck and shoulder discomfort.

It is another object of the present invention to provide an inflatable incline mattress that is small enough for easy transport.

It is another object of the present invention to provide an inflatable incline mattress that eliminates the need for infants with GERD to sleep in car seats.

It is another object of the present invention to provide an inflatable incline mattress that eliminates the safety hazards of elevating the head end of a crib.

It is another object of the present invention to provide an inflatable incline that does not interfere with the sleeping habits or preferences of the user's partner and thus, allowing couples to continue to share the same sleeping space.

In satisfaction of these and related objects, the present invention is an inflatable incline mattress that is inexpensive, portable, easily inflated or deflated, allows for sleep in many positions, and effectively relives GERD in adults or infants.

The subject invention, however, in other embodiments, need not achieve all these objectives and the claims hereof should not be limited to structures or methods capable of achieving these objectives.

BRIEF DESCRIPTION OF THE DRAWINGS

The foregoing and other objects, features, and advantages of the invention will be apparent from the following more particular description of preferred embodiments as illustrated in the accompanying drawings, in which reference characters refer to the same parts throughout the various views. The drawings are not necessarily to scale, emphasis instead being placed upon illustrating principles of the invention.

DETAILED DESCRIPTION OF THE PREFERRED EMBODIMENT

Figure 1:
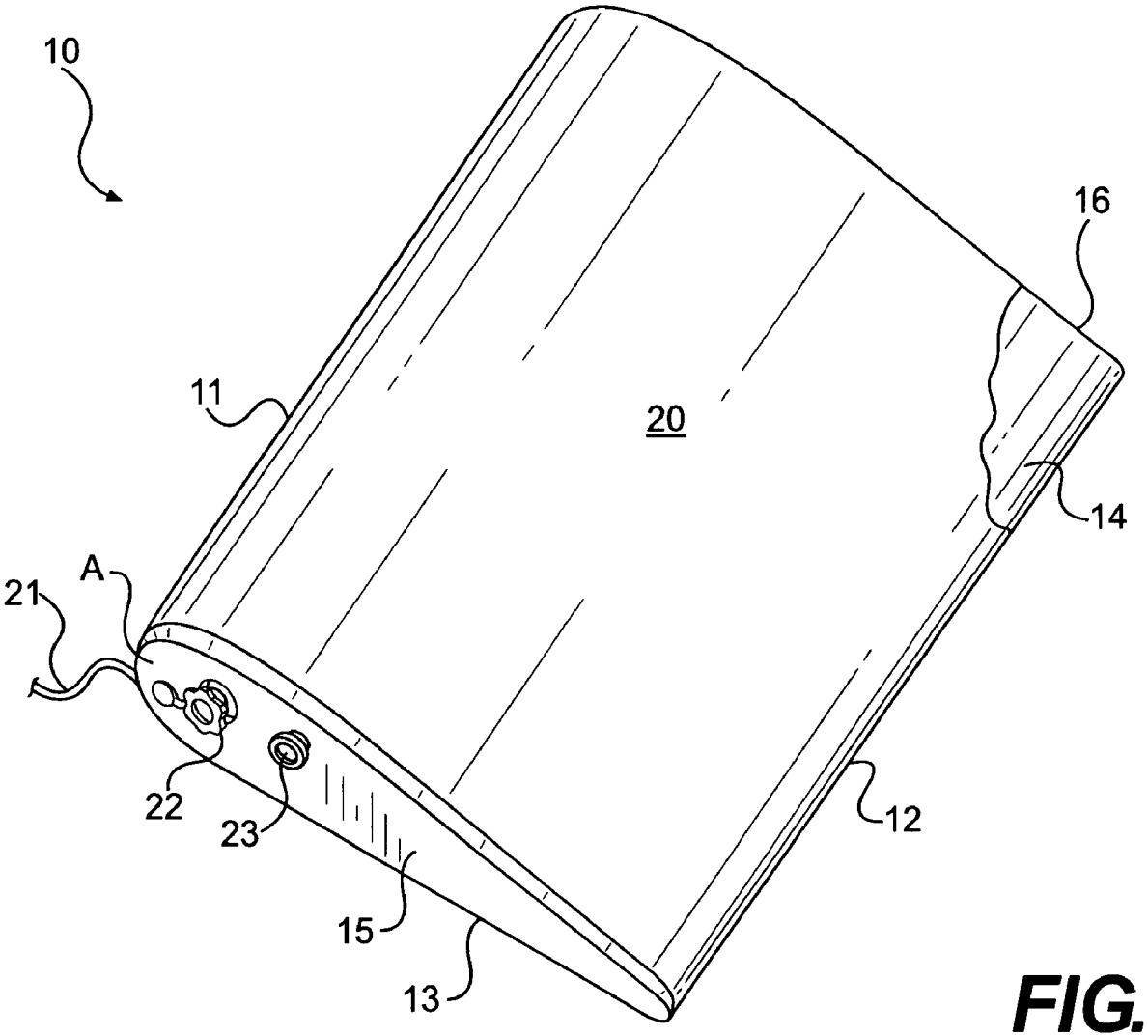
FIG. 1 shows a superior view of a king size (78 inches wide by 80 inches tall) version of the present invention in its preferred embodiment and in the inflated position with the 2 inch memory foam side facing up (a portion of the memory foam pad is cut away to show the mattress top underneath)

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. It is to be understood that other embodiments may be utilized and structural changes may be made without departing from the scope of the invention. Moreover, the claims hereof are not to be read restrictively unless there is clear and convincing evidence manifesting a certain exclusion, restriction, or disclaimer.

Figure 2:
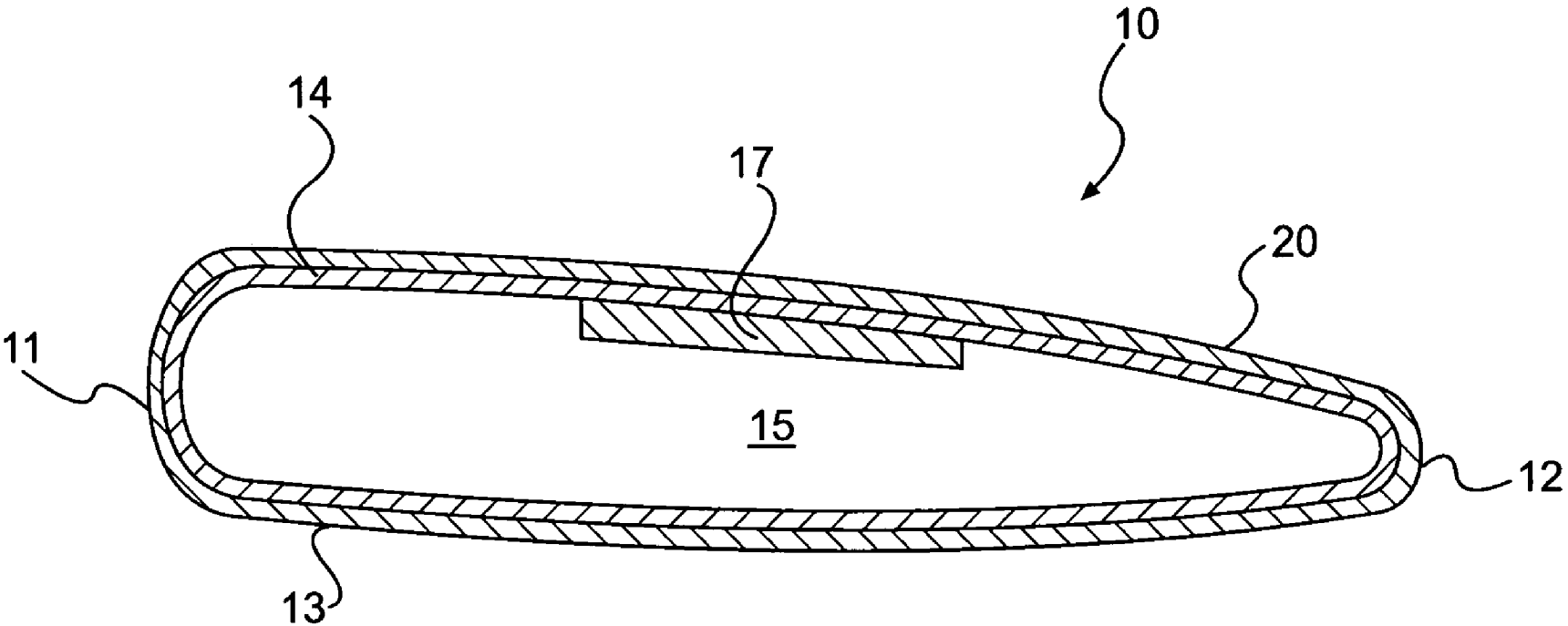
FIG. 2 is a cross-sectional view of the preferred embodiment of the invention.

In the preferred embodiment of the invention, the size of the inclined mattress 10 is sized to coordinate with standard bed sizes. For example, in order to maximize the ability to use existing sheets, blankets and bed covers, the inclined mattress of the present invention will be provided in at least king, queen, double, twin, and infant crib sizes. As shown in FIGS. 1 and 2, the mattress at the extreme top edge 11 (top or head of the mattress) is much thicker in cross section than at the extreme bottom edge 12. In the preferred embodiment of the invention, the inclined mattress 10 is about 10 inches in height from the bottom surface 13 to the top surface 14 (at the extreme top edge 11), and, for example, 78 inches from side 15 to side 16.

In the preferred embodiment of the invention, the inclined mattress 10 is about 2 inches in height measuring from the bottom surface 13 to the top surface 14 (at the extreme bottom edge 12) (foot or bottom of the mattress), and, for example 78 inches from side to side. Thus, the height of the mattress of the preferred embodiment varies by about 8 inches in total height differential from head to foot, providing a substantially uniform gradient from the foot of the mattress to the head of the mattress. Of course, in much smaller mattresses, such as those found in baby cribs, the difference in thickness is much less given the smaller size of the crib mattress. This incline lowers the feet, but raises the head, relative to the stomach of a person laying on the mattress (a loaded condition), and uses gravity to help keep the contents of the stomach moving in a normal downward direction without causing the body to bend at the waist. Ideally, the incline gradient should be such that the sleeper's head (not shown) is elevated between 6 and 8 inches, and the sleeper's stomach (not shown) is elevated above the user's feet and below the upper body.

For a king-sized bed, both the top (sleeping) surface 14 and bottom surface 13 are 80 inches from head to foot. The resultant configuration is an elongated wedge shape. In the preferred embodiment of the invention, the top 2 inches of the sleeping surface can be, for example, constructed of hypoallergenic memory foam pad 20 or other additional support layer. This support layer can be held in place by the bed sheets, by tie downs, by a Velcro system or it may be permanently attached or welded to the inflatable PVC body of the mattress. For ease of transportation, storage and cleaning, however, the memory foam pad 20 can be removably secured to the mattress. The power cord 21 and electrical on/off motor switch 22 are located on one side of the wedge. When lying on the mattress, this would place the controls of the preferred embodiment above the right shoulder.

In the preferred embodiment of the invention, an electric, motor-driven, two-way, air in/air out pump (not shown) is housed within the mattress 10 in the upper right hand corner at the widest/deepest part of the mattress and plugs in to any 110 v outlet. The pump would be a UL-listed 110 v pump, 60 Hz, 1.7 Ampere, with a standard U.S. two-prong plug and cord.

A quick release one way (out) deflation air valve 23 is located just below or distally from the motor, which allows for the quick release of air from the inflatable mattress chamber. The body (chamber) of the wedge-shaped air mattress 10 of the present invention is constructed of, for example, 18 gauge, heavy duty poly-vinyl chloride (PVC). In order to reduce bending of the mattress about the user's waist when loaded by the user's weight, and thus further reduce the bending of the body, it is desirable to add reinforcing layer 17 in the middle portion of the mattress (as shown in FIG. 2).

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

I claim:

1. A supplemental inflatable incline mattress for use on top of an existing sleep mattress to reduce the effect of Gastric Esophageal Reflux Disease (GERD) comprising:

at least one air bladder adapted to inflate upon insertion of a gaseous fluid;

a sealable air port to selectively facilitate insertion and removal of said gaseous fluid into and out of said at least one air bladder, said at least one air bladder being operatively connected and used in combination with and on top of the existing sleep mattress to reduce the effect of GERD, said at least one air bladder having a generally planar bottom surface that is sized to cover the existing sleep mattress and, when said at least one air bladder is properly inflated, provides an inclined top surface; and an additional support layer comprised of a memory foam pad removably secured to said inclined top surface which is constructed so as to reduce localized pressure on said air bladder by more evenly distributing a user's weight across said inclined top surface thereof;

wherein, in an unloaded state, said incline mattress is thicker at one extreme edge than at an opposite extreme edge and said inclined top surface has a substantially uniform gradient of at least 1 inch rise for every 10 inches of length from one extreme edge of the supplemental inflatable mattress to the opposite extreme edge of said mattress.

2. The supplemental inflatable incline mattress as in claim 1, wherein said uniform gradient is 1 inch rise for every 9.75 inches of length of the supplemental inflatable incline mattress.

3. The supplemental inflatable incline mattress as in claim 1, wherein said incline mattress is more than 5 inches and not less than 10 inches thicker at one extreme edge that it is at the opposite extreme edge when unloaded.

4. The supplemental inflatable incline mattress as in claim 1, wherein said memory foam additional support layer is approximately 2 inches thick.

5. The inflatable incline mattress as in claim 4, wherein said memory foam pad is formed of a hypo-allergenic material.

6. The supplemental inflatable incline mattress as in claim 1, wherein said incline mattress is formed of 18 gauge, heavy duty poly-vinyl chloride (PVC).

7. The supplemental inflatable incline mattress as in claim 1, wherein said mattress is sized to fit a standard infant crib sized bed.

8. The supplemental inflatable incline mattress as in claim 1, wherein said inclined top surface is reinforced at an area approximately equal distant from said opposite extreme edges such that said inclined mattress resists bending when loaded.

9. A method for treating Gastric Esophageal Reflux Disease (GERD) comprising the steps of:

selecting an inflatable inclined mattress having at least one air bladder that will inflate upon insertion of a gaseous fluid and being sized to match an existing sleep mattress and form an angled top sleep surface;

placing said inflatable inclined mattress on top of said existing sleep mattress;

inflating said at least one air bladder to create a supplemental inflatable inclined mattress having the angled top sleep surface that has a substantially uniform gradient of at least 1 inch rise for every 10 inches of length from a bottom edge of the supplemental inclined inflatable mattress to an opposite top edge of said mattress;

placing a memory foam pad on said angled top sleep surface; and securing said memory foam pad to said supplemental inflatable inclined mattress;

wherein said memory foam pad is approximately 2 inches thick and constructed so as to reduce localized pressure on said air bladder by more evenly distributing a user's weight across said angled top surface.

10. The method as in claim 9, wherein said memory foam pad is removably secured to said supplemental inflatable inclined mattress.

* * * * *